United States Patent [19]

Pucillo

[11] Patent Number: 4,988,063

[45] Date of Patent: Jan. 29, 1991

[54] SUPPORT AND POSITIONING ASSEMBLY FOR A SPRAY NOZZLE

[76] Inventor: Robert Pucillo, P.O. Box 557442, Miami, Fla. 33155-7441

[21] Appl. No.: 302,487

[22] Filed: Jan. 27, 1989

[51] Int. Cl.[5] ..... A47G 29/00

[52] U.S. Cl. ..... 248/83; 248/163.1

[58] Field of Search ..... 248/83, 84, 85, 49, 248/163.1, 165, 166, 157; 239/280, 280.5

[56] References Cited

U.S. PATENT DOCUMENTS

| | | | |
|---|---|---|---|
| 355,347 | 1/1887 | Sergeant | 248/651 X |
| 386,524 | 7/1888 | Casler | 248/163.1 |
| 408,058 | 7/1889 | Willits | 248/82 |
| 1,637,523 | 8/1927 | Hamilton | 248/82 |
| 2,386,266 | 10/1945 | Robertson | 248/163.1 X |
| 2,792,257 | 5/1957 | Davis | 248/83 |
| 2,965,305 | 12/1960 | Glazer | 248/163.1 X |

FOREIGN PATENT DOCUMENTS 860142 12/1952 Fed. Rep. of Germany ... 248/163.1

*Primary Examiner*—J. Franklin Foss

*Attorney, Agent, or Firm*—Malloy, Downey & Malloy

[57] ABSTRACT

A support assembly for a spray nozzle specifically structured to deliver liquid and/or cleaning chemicals under high pressure to air conditioning coils or large commercial type air conditioning units for the cleaning thereof in order to render operation of the entire air conditioning assembly more efficient. The spray nozzle is adjsutably and removably positioned relative to the air conditioning coils being cleaned thereby eliminating the need for personnel to physically handle and position the spray nozzle during the cleaning proess wherein the presents of personnel is frequently difficult to maintain and dangerous or hazardous to the health of the personnel due to the enclosed and resulting harsh environmental conditions under which such cleaning of air conditioning coils normally takes place.

9 Claims, 2 Drawing Sheets

SUPPORT AND POSITIONING ASSEMBLY FOR A SPRAY NOZZLE

BACKGROUND OF THE INVENTION

1. Field of the Invention

This invention relates to an assembly for the adjustable support and selective positioning of high pressure spray nozzle intended to deliver cleaning liquid to the coil of large industrial size air conditioning assemblies of the type associated with large buildings, such as airports, assembly halls, etc.

2. Description of the Prior Art

Air conditioning facilities for large indoor areas such as airports, assembly halls, commercial buildings, theaters, etc. involve the use of extremely large cooling coils generally defined by a plurality of fins disposed in immediately adjacent side by side relation to one another. The continued uses of such air conditioning facilities over a prolonged period of time naturally involves periodic cleaning and like maintenance to ensure that the air conditioning facility work at peak efficiency. However, in the maintenance of such air conditioning facility one well recognized problem is the cleaning of the coils of the type having the above noted fin like construction. Typically a high pressure spray nozzle issuing water or applicable cleaning fluid such as chemicals are directed on the cleaning coils in order to remove any accumulated dust, dirt, etc. from between the fin like configurations. The cleaning liquid issues from the spray nozzle under sufficient pressure to reach the rather small, confined area. In addition, the manipulation and maintenance of such spray nozzle, so as to efficiently reach all portions of the coils to be cleaned, presents an additional problem. The coils are generally located in a confined area. Therefore it is extremely difficult for personnel operating and handling the spray nozzle to remain in the area where the coils are located for any prolonged period of time. Adding to harsh environmental condition in which such spray nozzles must operate is the fact that frequently the coils are cleaned by liquid and or steam at uncomfortably high temperatures. Accordingly, there is an obvious need for a support and positioning assembly capable of positioning the high pressure nozzle at a preferred location relative to their impingement of cleaning fluid directing on the coil in a manner which allows the spray nozzle to be easily adjusted to effectively clean all areas of the coil. Presence of such a support assembly for a high pressure spray nozzle would thereby eliminate the necessity of one or more laborers or trained personnel from having to remain in the area where such coils are typically located for any prolonged period of time.

There are numerous structures in the prior art designed to hold various types of spray nozzles. The majority of these support assemblys are directed to the positioning and maintaining of a garden hose type structure for the watering of lawns or like ground surface areas. Such U.S. Pat. Nos. include 807,184; 684,220; 916,255; 1,590,910; 2,031,278; 2,045,336 and 3,645,484. It should be emphasized that the structure disclosed in the above noted patents are presented as being representation only of prior art development and none are believed to perform the function, service and utility of a perferredsupport assembly necessary to maintain a high pressure spray nozzle in direct cleaning relation to fin type air conditioning coils.

SUMMARY OF THE INVENTION

The present invention relates to a support and positioning assembly for a high pressure cleaning nozzle designed to deliver high pressure cleaning fluid such as water, chemicals, steam, etc, onto air conditioning coils of the type utilized in large commercial type air conditioning facilities. Cleaning of the coils, as set forth above is a necessity in order to operate the air conditioning facility efficiently and eliminate on the compressor or drive motors strain of the facility when, for example, the air conditioning facility is operated while the coils are dirty, clogged, etc. The assembly comprises two specific but yet preferred embodiments differing from one another primarily in there manner of being adjustably supported relative to the coils being cleaned.

In one preferred embodiment a support portion of the assemble comprises two leg pairs each disposed on a supporting surface such as a floor, ground, etc. and extending upwardly therefrom into supporting engagement with a base having a elongated configuration and extending between the leg pairs. Further, each of the leg pairs are structured to be rotatably or pivotally secured to the base such that in a raised position the leg pairs are disposed in substantially spaced apart parallel relation to one another. To the contrary when in a lowered position the leg pairs are defined by spaced apart, angularly oriented relation to one another. Another structural feature of the support portion comprises telescopic longitudinally extendable leg segments associated with the various leg pairs such that the base and the spray nozzle attached thereto again may be raised or lowered to an effective high position for cleaning the portions of the air conditioning coils intended. A mounting means is secured to the base and extends outwardly therefrom in supporting engagement with the spray nozzle. The mounting means includes a mounting sleeve disposed of in surrounding relation to a length of the spray nozzle and a locking or connecting type structure attached thereto such that the spray nozzle maybe adjusted along its length within the sleeve. Further the mounting means includes an elongated finger having one end rotatably secured by an appropriate bracket connected to the base so as to be rotatable about its longitudinal axis as well as being positioned along the base. The other end of the finger is secured to the mounting sleeve such that the sleeve may be rotatable relative to the longitudinal axis of the finger. An effective universal positioning of the spray nozzle may thereby occur. This adds to the versatility of the subject support assembly by allowing precise positioning of the spray nozzle and more particularly the cleaning fluid issuing therefrom onto appropriate portions of the coil structure to be cleaned.

An additional preferred embodiment of the present invention comprises the base portion having an elongated configuration and the support portion thereof defined by two support members secured to opposite ends of the base. These are adjustably disposed outwardly therefrom in coaxial relation thereto and into engaging relation with oppositely disposed substantially parallel wall surfaces or like support surfaces. The base therefore has a similar support facility as a shower curtain rod with obvious structural differences.

In this embodiment a connecting means comprises a connecting sleeve which is either manually or "automatically" positioned along the length of the base. The mounting means, is similar to the mounting means in the above noted embodiment wherein the mounting means includes a mounting sleeve concentrically surrounding and supporting a length of the spray nozzle therein. The spray nozzle may be selectively positioned along its length relative to the sleeve to vary its location. A mounting finger has one end secured to the connecting sleeve of the afore mentioned connecting means and extends outwardly therefrom to an opposite end which is connected to the mounting sleeve. The mounting sleeve is rotatable along the longitudinal axis of the finger relative to the connecting sleeve and base.

A congruent multi-sided configuration is present in both the cross sectional configuration of the base and the cross sectional configuration of the connecting sleeve so as to prevent relative rotation therebetween. This prevention of relative rotation will over come any tendency of the spray nozzle to exert a twisting force of torque on the connecting sleeve relative to the base when the cleaning fluid issues from the spray nozzle under a sufficiently high pressure.

The invention accordingly comprises of features of construction, combination of elements, and arrangement of parts which will be exemplified in the construction herein after set forth, in the scope of the invention will be indicated in the claims.

BRIEF DESCRIPTION OF THE DRAWINGS

For a fuller understanding of the nature of the present invention, reference should be had to the following description taken in connection with the accompanying drawings in which.

Like reference symbols refer to like parts throughout the several views with drawings.

DETAILED DESCRIPTION OF THE PREFERRED EMBODIMENT

Figure 1:
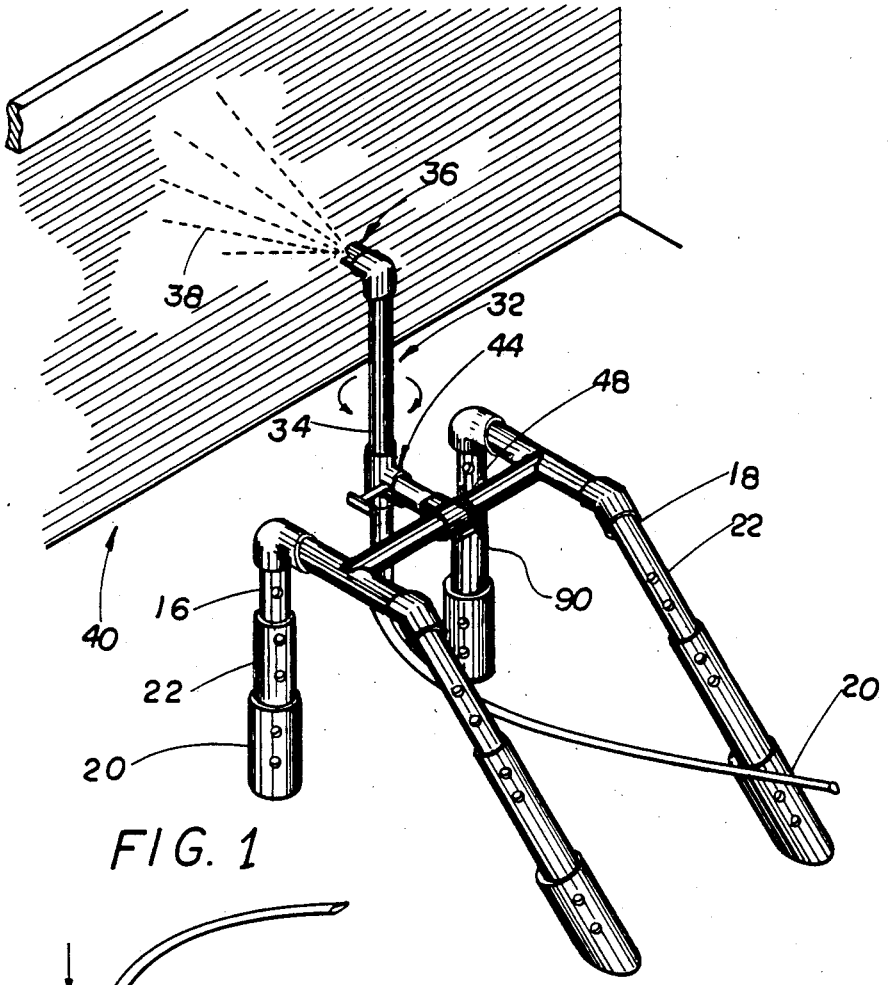
FIG. 1 is a perspective view of the assembly relative to air conditioning coils to be cleaned.
Figure 2:
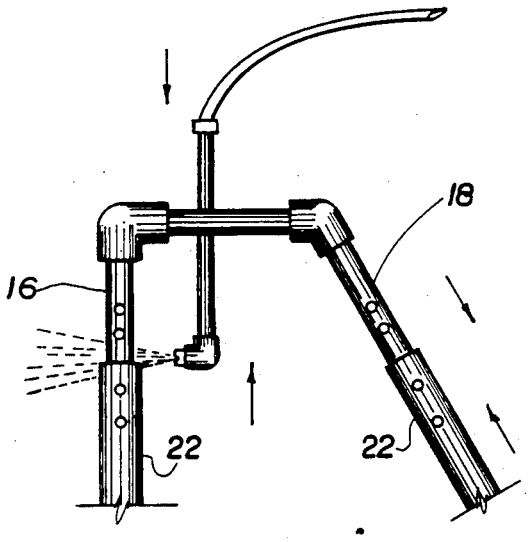
FIG. 2 is a side view showing a different positioning of a spray nozzle relative to the support assembly.
Figure 3:
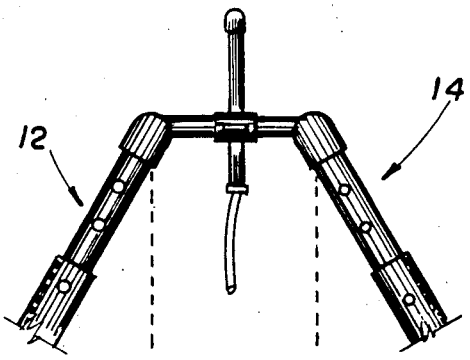
FIG. 3 is an end view in partial phantom.

One preferred embodiment of the present invention is shown in FIGS. 1 to 3 wherein the support and positioning assembly of the present invention is seen to comprise a support portion in the form of two leg pairs 12 and 14. Each leg pair comprises two legs 16 and 18. Each leg 16 and 18 includes at least one but preferably a plurality of leg segments 20 and 22 concentrically disposed relative to one another and to the correspondingly positioned leg 16 and 18. At lest one of the leg segments as at 20 is longitudinally extendable relative to the other leg segment 22 and to the corresponding leg portions 16 and 18. Accordingly in the position shown in FIGS. 1 and 2 an outer extension of one or both of the leg segments 20 and 22, relative to the appropriately disposed legs 16 and 18, selectively positions the entire assembly in a raised position. In the position shown in FIG. 1 the segments are retracted so as to define a lowered position.

It is also important to note that the legs 16 and 18 may be absent any telescoping, longitudinally extending section 20 and 22 as pictured in FIG. 2 and 3. In this embodiment the aforementioned raised or lowered position of the assembly is accompanied by a rotational or pivotal connection of each leg pair 12 and 14 at a junction or a connection. The raised position is defined by the leg pairs 12 and 14 being disposed in substantially parallel spaced apart relation to one another as presented in phantom lines in FIG. 3. To the contrary the lower position is defined by an angular orientation of the leg pairs 12 and 14 as presented in solid lines in FIG. 2.

An elongated base portion as at 90 has its opposite ends connected to the leg pairs 12 and 14 in either of the embodiments of FIGS. 1 and 2. The spray nozzle generally indicated as 32 has an elongated configuration as at 34 in the form of a hollow pipe or conduit through which fluid flows. The spray head as at 36 is connected at one end of the elongated body portion 34 and may be selectively positionable, as well be evident in greater detail hereinafter so as to direct or drive cleaning fluid 38 onto the fin like air conditioning coils. The spray nozzle 32 is connected and supported on the base portion 90 by a mounting means generally indicated 44. The mounting means includes a mounting sleeve disposed in concentric, surrounding relation to the elongated pipe 34 of the spray nozzle 32. The relative dimensions of the mounting sleeve and the elongated pipe 34 are such as to allow the spray nozzle to be adjustable along the length of the pipe 34 relative to the position of the mounting sleeve. Further the pipe 34 is rotatable about its own longitudinal axis relative to the mounting sleeve.

A connecting means in the form of connecting finger is connected at one end to the mounting means as clearly shown in FIG. 1 and 2 and has the other end connecting to a connecting sleeve 48 The connecting sleeve surrounds and is moveable both longitudinal and rotationally relative to the base 90 and is congruently dimensioned to accomplish such movement. Apporpriate connectors may be utilized to maintain the spray head or nozzle 36 in a proper location relative to the base. Alternatively, a close friction type fit may exist between the elongated spray pipe or body portion 34 and the interior of the mounting sleeve of the means 44 as well as the connecting sleeve 48 and the exterior surface of the base 90.

The various positions of the spray head 36 should be apparent by review of FIGS. 1,2 and 3.

Figure 4:
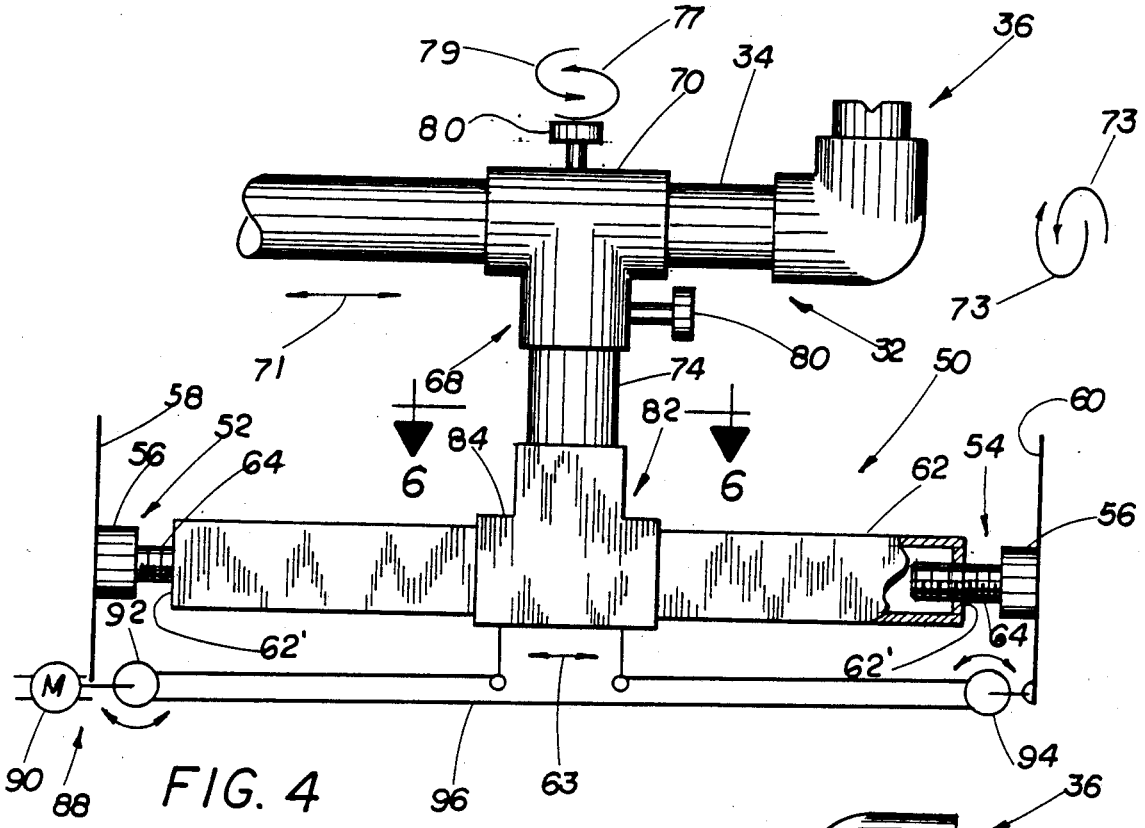
FIG. 4 is a top view of another embodiment of the present invention.
Figure 5:
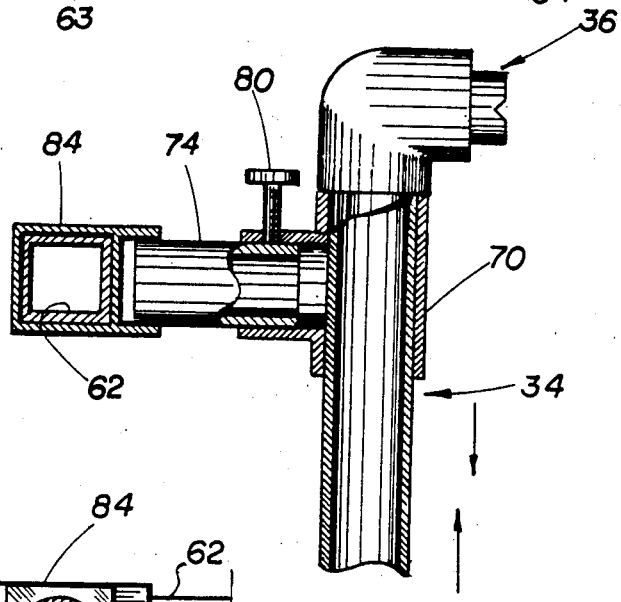
FIG. 5 is a sectional view of a partial cutaway of the embodiment of FIG. 4.
Figure 6:
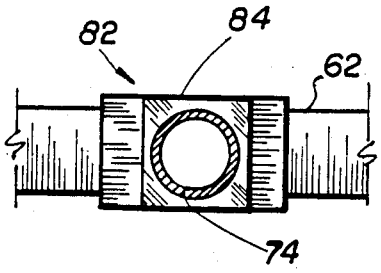
FIG. 6 is a sectional view along line 6—6 of FIG. 4.

Another embodiment of the present invention is shown in FIGS. 4, 5 and 6 and is generally indicated as 50. In this embodiment the support portion comprises two support assemblies generally indicated as 52 and 54 each having a securement member 56 forced into abutting, gripping engagement with a wall or like supporting surface 58 and 60 and being adjustably mounted so as to extend longitudinally outward from opposite ends of the base 62. Such longitudinal adjustment may comprise an exteriorly threaded stub shaft 64 attached to each of the gripping members 56 and being connected in threaded engagement with the end portions 62' of the base 62 as shown.

Similar to the embodiment of FIG. 1, the embodiment of FIG. 4 includes a mounting assembly generally indicated as 68 including a mounting sleeve 70 concentrically disposed in supporting engagement about the exterior surface of the elongated pipe 34 of the spray nozzle 32. As set forth above, in regard to the embodiment of FIG. 1 the length of the spray pipe 34 may be longitudinally adjustable within the sleeve 70 in accordance with directional arrows 71 or may be rotated relative to the mounting sleeve 70 in each of two opposite directions in accordance with the directional arrows 73 and 75. The mounting finger 74 is connected at one end to the mounting sleeve 70. The mounting sleeve 70 is rotatable relative thereto as indicated by directional arrows 77 and 79. A set screws or like connectors 80 may be utilized to maintain fixed positions between the mounting sleeve 70 and the mounting finger 74.

A connecting means is generally indicated as 82 and includes a connecting sleeve 84 concentrically disposed about the exterior surface of the base 62 and moveable along the length thereof in each of two opposite directions as indicated by the directional arrows 63. Both the interior surface of the connecting sleeve 84 and the exterior surface of the base 62 are defined by concurrent multi-sided configurations which prevent relative rotation between these to elements.

While the connecting sleeve 84 maybe moved manually along the length of the base 62, another embodiment contemplates an automatic positioning or driving means generally indicated as 88 including a drive motor 90 connected to a drive pulley 92 secured preferably to one of the surfaces as at 158. A cable arrangement is interconnected between the drive pulley 92 and a driven pulley at opposite free ends of the cable 96 being connected to the connecting sleeve 84. Activation of the drive motor 90 in either of two opposite directions causes the connecting sleeve 84 and accordingly the attached spray nozzle 32 to be moved along the length of the base 62 to a desired location for proper cleaning.

What is claimed is:

1. A support and positioning assembly for a spray nozzle used in cleaning a coil structure in an air conditioning unit, said assembly comprising:

a. a support portion removably positioned on and extending upwardly from a supporting surface, b. a base portion having an elongated configuration and extending between and supported by opposite sides of said support portion, c. a mounting means movably connected to said base and connected to the spray nozzle and structured for mounting the spray nozzle on the support portion, d. said support portion including a support leg assembly supportingly connected to said base portion and adjustably positionable to raise or lower said base portion and said mounting means attached thereto relative to the supporting surface, e. said mounting means and the spray nozzle attached thereto and movable along the length of said base portion and selectively raised or lowered with said base portion relative to the supporting surface, f. whereby the spray nozzle is selectively positionable and supported in any one of a variety of positions for spray washing portions of the coil structure for a prolonged period of time, g. said leg assembly comprising two leg structures each connected in supporting relation to an opposite end of said base portion and removably positionable relative to said base between a raised and a lowered position, h. each leg structure being movable relative to a correspondingly positioned opposite end of said base portion between an upright, substantially transverse relation to said base portion and thereby defining said raised portion and an outwardly extending substantially angularly oriented position defining said lowered position, and i. said mounting means comprising a mounting sleeve structured to removably receive and secure the spray nozzle therein, the spray nozzle being adjustable along its length relative to said sleeve.

2. An assembly as in claim 1 wherein said mounting sleeve is selectively positionable and securable along the length of the spray nozzle.

3. An assembly as in claim 2 wherein said mounting sleeve is rotatably connected to said base and positionable radially outward relative thereto along a 360 degree arc of rotation relative to a central longitudinal axis of said base.

4. An assembly as in claim 3 further comprising a securing link interconnecting sleeve to said base portion, said securing link having one end rotatable relative to said central longitudinal axis of said base portion, an opposite end of said securing link rotatable connected to said sleeve, said sleeve rotatable about a central axis of said securing link.

5. An assembly as in claim 1 wherein each leg structure is rotatable relative to a correspondingly positioned end of said base portion and selectively positionable between said raised and said lowered position.

6. An assembly as in claim 5 wherein each of said leg structures comprises a leg pair including two legs disposed in spaced apart relation to one another and fixedly connected to one another by a connecting link.

7. An assembly as in claim 6 wherein said connecting link and a corresponding one of said leg pairs is rotatably connected to a corresponding opposite end of said base portion and positionable between said raised position and said lowered position.

8. An assembly as in claim 7 wherein said mounting sleeve and the spray nozzle attached thereto are movable horizontally along the length of said base and said base, said mounting sleeve and said spray nozzle are movable vertically relative to the support surface upon adjustment of said leg structures.

9. An assembly as in claim 6 wherein each leg of each of said leg pairs comprises a plurality of leg segments connected in concentric relation to one another an including at least one leg segment extendable longitudinally of the other leg segment and selectively positionable between an extended position and an retracted position.

* * * * *